US011203451B2

(12) United States Patent
Chen et al.

(10) Patent No.: US 11,203,451 B2
(45) Date of Patent: Dec. 21, 2021

(54) MULTIFUNCTION CAP REPLACEMENT MODULE

(71) Applicants: Marketech International Corp., Taipei (TW); Hsao-Szu Chang, Miaoli County (TW)

(72) Inventors: Ping-Hsu Chen, Taichung (TW); Chien-Kuo Lu, Hsinchu (TW); Chi-Yuan Pung, Hsinchu (TW); Chi-Ta Yeh, Hsinchu County (TW); Hsao-Szu Chang, Miaoli County (TW)

(73) Assignees: Marketech International Corp., Taipei (TW); Hsao-Szu Chang, Miaoli County (TW)

( * ) Notice: Subject to any disclaimer, the term of this patent is extended or adjusted under 35 U.S.C. 154(b) by 175 days.

(21) Appl. No.: 16/669,540

(22) Filed: Oct. 31, 2019

(65) Prior Publication Data

US 2020/0377294 A1 Dec. 3, 2020

(30) Foreign Application Priority Data

Jun. 3, 2019 (TW) ..... 10820704.7

(51) Int. Cl.

| | |
|---|---|
| ***B65B 7/28*** | (2006.01) |
| ***B67B 7/18*** | (2006.01) |
| ***B65D 88/54*** | (2006.01) |
| ***B67B 7/42*** | (2006.01) |

(52) U.S. Cl.

CPC ..... *B65B 7/2835* (2013.01); *B65B 7/2828* (2013.01); *B65D 88/54* (2013.01); *B67B 7/182* (2013.01); *B67B 7/42* (2013.01)

(58) Field of Classification Search

CPC ..... B67B 7/182; B67B 7/42; B65D 88/54; B65D 7/2835; B65D 7/2828; B65B 7/2835; B65B 7/2828

See application file for complete search history.

(56) References Cited

U.S. PATENT DOCUMENTS

| | | | | |
|---|---|---|---|---|
| 4,635,509 | A * | 1/1987 | Nagao | B67B 7/164 53/381.4 |
| 10,807,744 | B1 * | 10/2020 | Seiver | B67B 3/28 |
| 2004/0089373 | A1 * | 5/2004 | Seiver | B67C 3/30 141/270 |
| 2014/0311090 | A1 * | 10/2014 | Weber | B25J 15/12 53/381.4 |
| 2015/0246803 | A1 * | 9/2015 | Holthaus | B67B 7/42 137/15.01 |
| 2020/0216210 | A1 * | 7/2020 | Corazza | B29C 66/8432 |

* cited by examiner

*Primary Examiner* — Atif H Chaudry

(74) *Attorney, Agent, or Firm* — CKC & Partners Co., LLC

(57) ABSTRACT

A multifunction cap replacement module includes a cap rotation module supporter and at least one cap rotation module. The cap rotation module is mounted to the cap rotation module supporter, and the cap rotation module includes a first cap rotation device and a second cap rotation device. The first cap rotation device is configured to open one sealing cap of at least one chemical drum and extract a chemical liquid from the chemical drum, and the second cap rotation device is configured to open another one sealing cap of the chemical drum and allow the chemical liquid to flow back to the chemical drum.

9 Claims, 3 Drawing Sheets

MULTIFUNCTION CAP REPLACEMENT MODULE

RELATED APPLICATIONS

This application claims priority to Taiwan Application Serial Number 108207047, filed Jun. 3, 2019, which is herein incorporated by reference.

TECHNICAL FIELD

The present disclosure generally relates to a cap replacement module. More particularly, the present disclosure relates to a multifunction cap replacement module.

BACKGROUND

With the booming of the domestic and international semiconductor markets in recent years, due to the demand for computers and the peripheral products thereof, the semiconductor industry has continued to expand, and created a large amount of foreign exchange earnings.

The manufacturing processes of semiconductor components are very complicated, and the technologies involved cover almost all of the most important and critical technologies and inventions of modern scientific research. Therefore, the semiconductor industry is not only a cutting-edge technology industry, but also requires a lot of money to maintain high-end research.

Due to the increasingly complicated design of semiconductor components, the manufacturing technologies of semiconductor components are becoming more sophisticated and complex, and the potential occupational hazards and property losses are becoming more serious in semiconductor processes. Chemicals are commonly used in processes such as epitaxy, diffusion, ions implantation, chemical vapor deposition, etching and lithography. The storage and usage in the semiconductor fabrication plant is much less than the storage and usage in a chemical or petrochemical plant. However, since the chemicals are flammable, toxic and corrosive, the chemical substances may cause personal injury and serious property damage if leakage or abnormal operation occurs.

In a semiconductor fabrication plant, chemical liquids are stored in chemical storage drums to connect to a supply line in the semiconductor fabrication plant. When the chemical liquid is used up, the chemical storage drum need to be replaced.

How to easily replace the chemical storage drum may improve the safety of the semiconductor fabrication plant, and further improve the yield thereof.

SUMMARY

One objective of the embodiments of the present invention is to provide a multifunction cap replacement module able to easily replace the chemical drum, thereby improving the safety and convenience of replacing the chemical drum.

To achieve these and other advantages and in accordance with the objective of the embodiments of the present invention, as the embodiment broadly describes herein, the embodiments of the present invention provides a multifunction cap replacement module including a cap rotation module supporter and at least one cap rotation module. The cap rotation module is disposed in the cap rotation module supporter and the cap rotation module includes a first cap rotation device and a second cap rotation device.

The first cap rotation device is configured to open a sealing cap of at least one chemical drum and extract a chemical liquid from the chemical drum. The second cap rotation device is configured to open another sealing cap of the chemical drum and flow the chemical liquid back to the chemical drum.

In some embodiments, the cap rotation module supporter includes a horizontal moving module is configured to move the cap rotation module around a plurality of chemical drums and align the cap rotation module with one of the chemical drums.

In some embodiments, the multifunction cap replacement module further includes a chemical drum storing device, and the chemical drum storing device includes a supporting frame to store the chemical drum and the cap rotation module supporter is fixed on the supporting frame.

In some embodiments, the cap rotation module further includes a base plate and a cap rotation module central post connected to the base plate. The first cap rotation device and the second cap rotation device are movably mounted on the base plate.

In some embodiments, the cap rotation module central post includes a ventilating channel to exhaust an evaporated chemical gas of the chemical drum out of the cap rotation module.

In some embodiments, the first cap rotation device includes a cap rotator, a liquid extractor and an optical detecting device, and the optical detecting device detects a position of the sealing cap of the chemical drum to guide the cap rotator to align with the sealing cap, and the cap rotator opens the sealing cap and the liquid extractor extracts the chemical liquid.

In some embodiments, the second cap rotation device includes a cap rotator, a liquid reflux device and an optical detecting device, and the optical detecting device of the second cap rotation device detects a position of another sealing cap of the chemical drum to guide the cap rotator of the second cap rotation device to align with the another sealing cap, and the cap rotator of the second cap rotation device opens the another sealing cap, and the liquid reflux device flows the chemical liquid back to the chemical drum.

In some embodiments, the multifunction cap replacement module further includes a fixing plate, a vertical moving device, and a horizontal moving device. The vertical moving device is connected between the fixing plate and the first cap rotation device or the second cap rotation device to vertically move the first cap rotation device or the second cap rotation device. The horizontal moving device is connected between the fixing plate and the base plate to horizontally move the first cap rotation device or the second cap rotation device.

In some embodiments, the multifunction cap replacement module further includes an isolating plate and an elastic isolating shield connected to the isolating plate and the base plate to isolate the evaporated chemical gas of the chemical drum.

Hence, the multifunction cap replacement module can be safely and reliably mounted on the chemical drum storing device to transfer the chemical liquid of the chemical drum. The multifunction cap replacement module can also be mounted on a dedicated chemical drum storing device to transfer the chemical liquid of the chemical drum, without departing from the spirit and scope of the present invention. In addition, the multifunction cap replacement module can utilize single cap rotation module to operate a plurality of chemical drums for extracting and flowing back the chemical liquids. In addition, the multifunction cap replacement module can utilize a plurality of cap rotation module to operate a plurality of chemical drums for extracting and flowing back the chemical liquids, without departing from the spirit and scope of the present invention.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
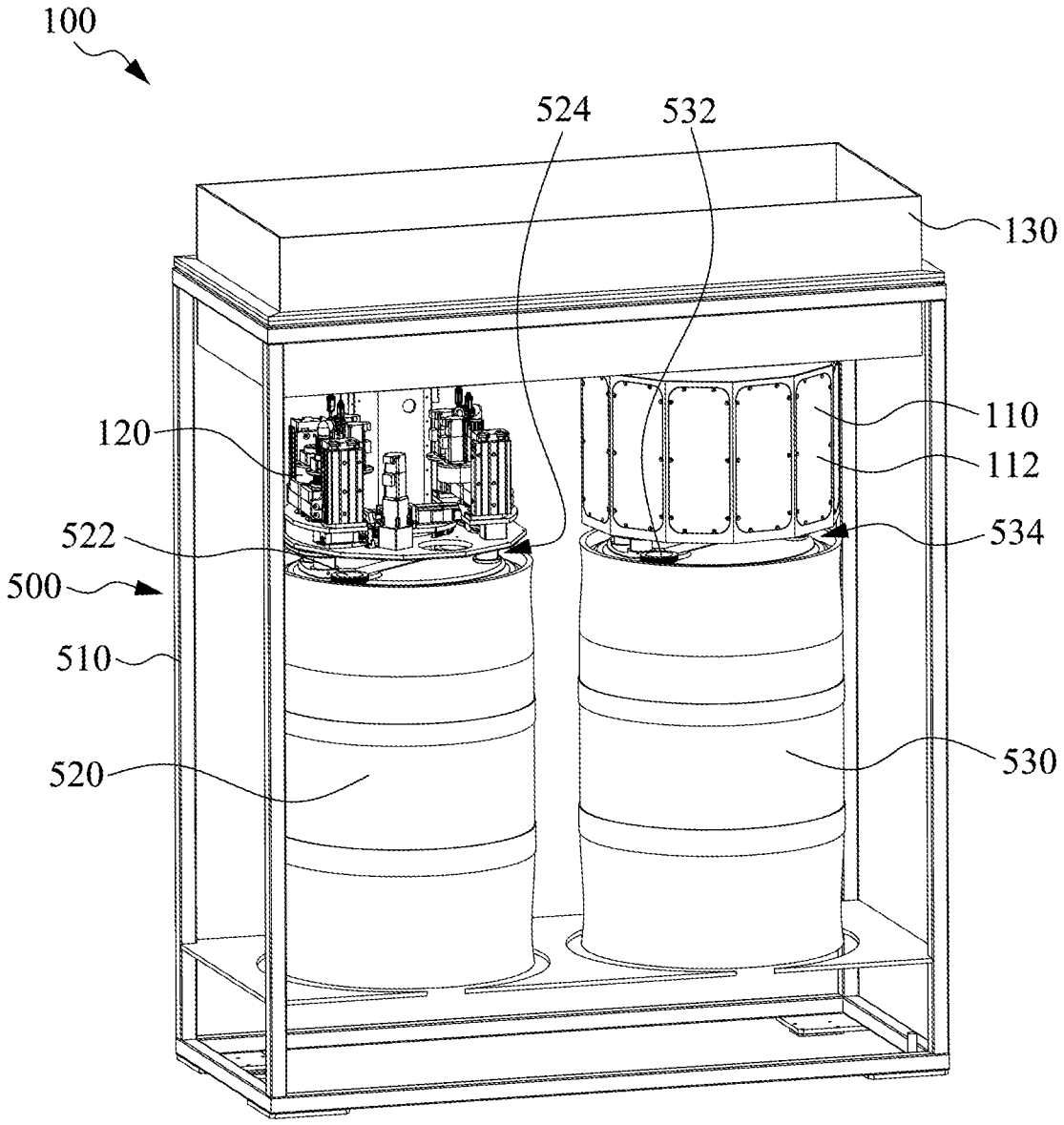
FIG. 1 illustrates a schematic perspective diagram showing a multifunction cap replacement module according to one embodiment of the present invention.
Figure 2:
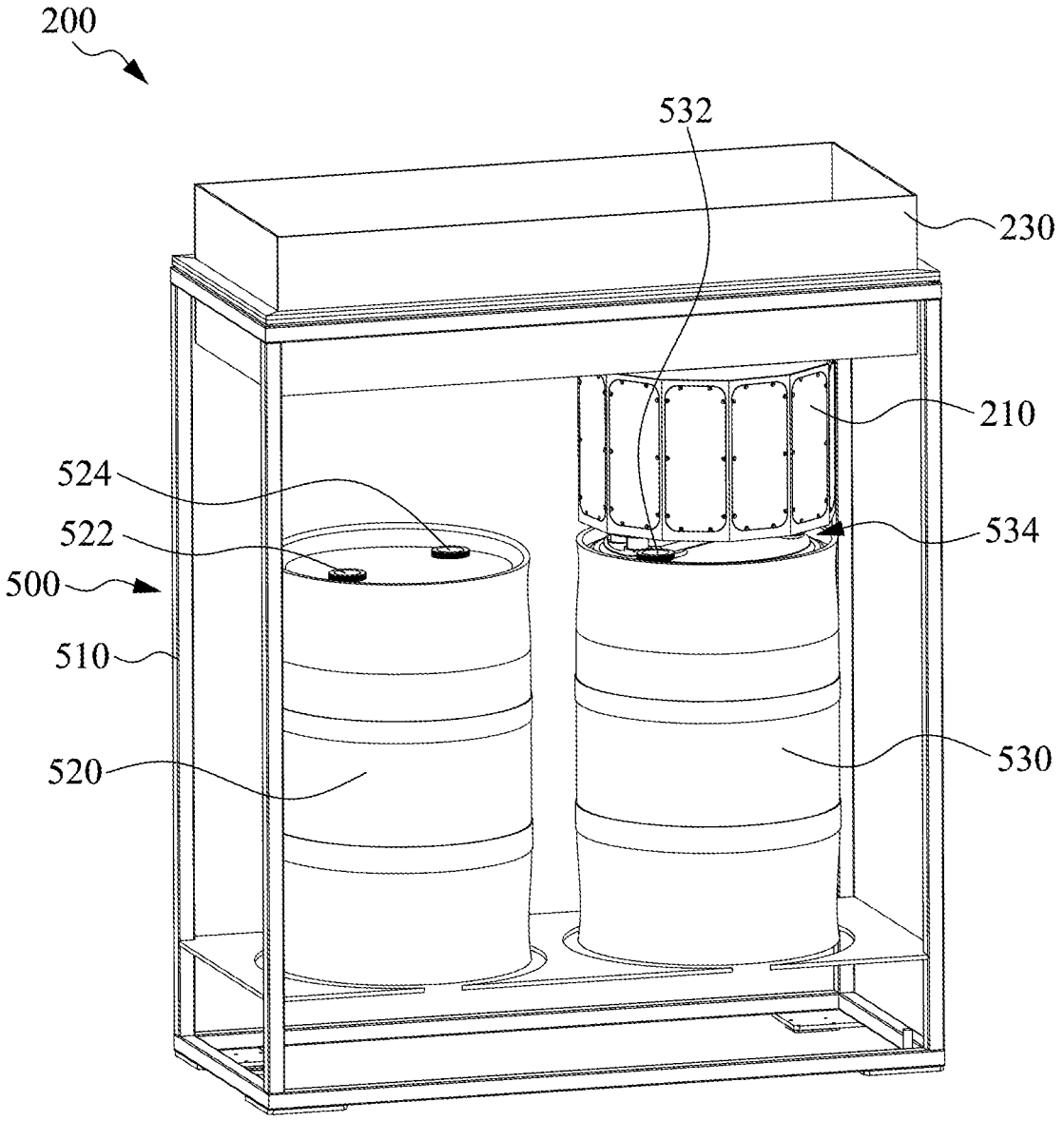
FIG. 2 illustrates a schematic perspective diagram showing a multifunction cap replacement module according to another embodiment of the present invention.
Figure 3:
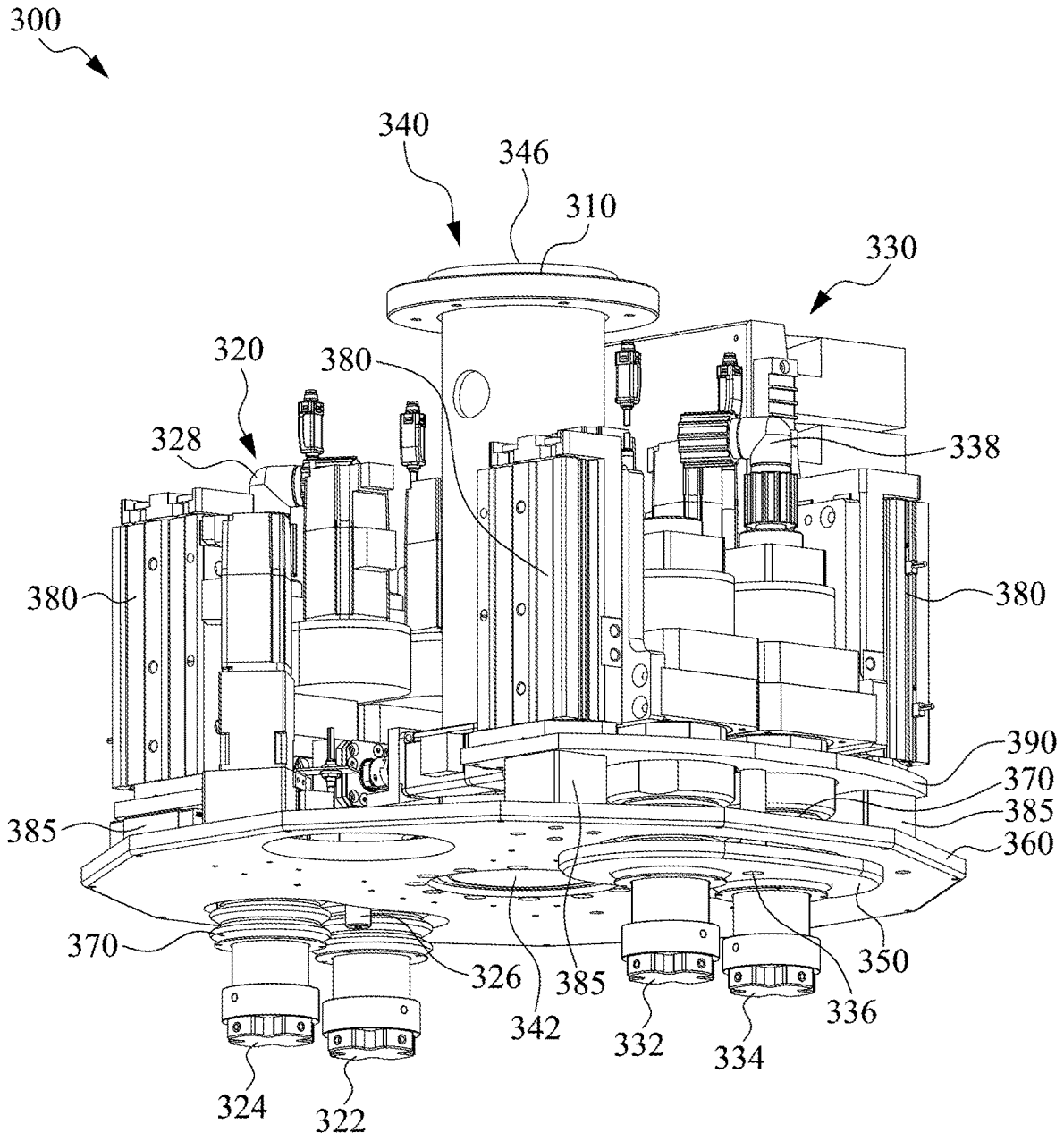
FIG. 3 illustrates a schematic perspective diagram showing a cap rotation module of a multifunction cap replacement module according to embodiments of the present invention.

FIG. 1 illustrates a multifunction cap replacement module according to one embodiment of the present invention, FIG. 2 illustrates a multifunction cap replacement module according to another embodiment of the present invention, and FIG. 3 illustrates a cap rotation module of a multifunction cap replacement module according to embodiments of the present invention.

Referring to FIG. 1, the multifunction cap replacement module 100 includes a cap rotation module supporter 130, a cap rotation module 110 and another cap rotation module 120. The cap rotation module 110 and another cap rotation module 120 are mounted under the cap rotation module supporter 130, and the cap rotation module supporter 130 is mounted on the chemical drum storing device 500. The chemical drum storing device 500 includes a supporting frame 510 to store at least one chemical drum, e.g. a chemical drum 520 and a chemical drum 530, and the cap rotation module supporter 130 can be additionally disposed above the supporting frame 510.

Further referring to FIG. 3, the cap rotation module 300 can be the cap rotation module 110 and/or the cap rotation module 120. The cap rotation module 300 includes at least one pair of cap rotation device, for example, a first cap rotation device 320 and a second cap rotation device 330 as illustrated in FIG. 3. The first cap rotation device 320 can open the sealing cap 532 of the chemical drum 530 and extract the chemical liquid form the chemical drum 530. The second cap rotation device 330 can open another sealing cap 534 of the chemical drum 530 to transfer the chemical liquid back to the chemical drum 530.

In addition, the cap rotation module 300 further includes a base plate 360 and a cap rotation module central post 310 connected to the base plate 360, and the first cap rotation device 320 and the second cap rotation device 330 are movably mounted on the base plate 360.

In some embodiments, the multifunction cap replacement module 100 includes a fixing plate 390, a vertical moving device 380 and a horizontal moving device 385. The vertical moving device 380, e.g. an air cylinder or a hydraulic cylinder, is connected between the fixing plate 390 and the first cap rotation device 320 or the second cap rotation device 330 to move the first cap rotation device 320 or the second cap rotation device 330 up and down, and the horizontal moving device 385 is disposed between the fixing plate 390 and the base plate 360 to horizontally move the first cap rotation device 320 or the second cap rotation device 330.

In some embodiments, the first cap rotation device 320 includes a cap rotator 322, a liquid extractor 324, an optical detecting device 326 and a liquid transferring pipe 328. The optical detecting device 326 can detect a position of the sealing cap 532 of the chemical drum 530 to guide the cap rotator 322 to align with the sealing cap 532, the cap rotator 322 opens the sealing cap 532, the liquid extractor 324 is moved to align with the original position of the sealing cap 532 and sealed to the opening, and the liquid extractor 324 extracts the chemical liquid and transfer the chemical liquid to the semiconductor manufacturing equipment in the semiconductor factory through the liquid transferring pipe 328.

In some embodiments, the second cap rotation device 330 includes a cap rotator 332, a liquid reflux device 334, an optical detecting device 336 and a liquid transferring pipe 338. The optical detecting device 336 of the second cap rotation device 330 can detect the position of another sealing cap 534 of the chemical drum 530 to guide the cap rotator 332 of the second cap rotation device 330 to align with the another sealing cap 534 of the cap rotator 332, the cap rotator 332 of the second cap rotation device 330 opens the sealing cap 534, and then the liquid reflux device 334 is moved to the original position of the sealing cap 534 and sealed to the opening to transfer the chemical liquid back to the chemical drum 530 with the liquid reflux device 334.

In some embodiments, the first cap rotation device 320 and the second cap rotation device 330 are the same or similar with each other to extract the chemical liquid and flow back the chemical liquid. In some embodiments, the first cap rotation device 320 and the second cap rotation device 330 can use different components to extract the chemical liquid and flow back the chemical liquid, without departing from the spirit and scope of the present invention.

In some embodiments, the cap rotator 322 and the liquid extractor 324 respectively include independent vertical moving devices 380 to independently control the cap rotator 322 and the liquid extractor 324 to move up and down. In addition, the cap rotator 332 and the liquid reflux device 334 also include independent vertical moving devices 380 to independently control the cap rotator 332 and the liquid reflux device 334 to move up and down.

In some embodiments, the multifunction cap replacement module 100 further includes an isolating plate 350 and an elastic isolating shield 370. The isolating plate 350 includes openings that allow the cap rotator 322 and the liquid extractor 324, or the cap rotator 332 and the liquid reflux device 334 to pass through. The elastic isolating shield 370 connects to the isolating plate 350 and the base plate 360 to prevent the evaporated chemical gas of the chemical drum 530 from directly contacting, polluting and corroding the interior components of the cap rotation module 300. The isolating plate 350 of the first cap rotation device 320 has the same shape with the isolating plate 350 of the second cap rotation device 330. In order to illustrate the interior components, the isolating plate 350 of the first cap rotation device 320 is omitted in FIG. 3.

In some embodiments, simultaneously referring to FIG. 1, the multifunction cap replacement module 100 utilizes the base plate 360, the isolating plate 350 and the elastic isolating shield 370 to effectively isolate the evaporated chemical gas from the interior components of the cap rotation module 110 and the cap rotation module 120 of the multifunction cap replacement module 100 to improve the safety and reliability of the multifunction cap replacement module 100 in use. In addition, the cap rotation module 110 further includes sealing walls 112 connected to the base plate 360 to prevent the evaporated chemical gas from contacting the interior components of the cap rotation module 110 and the cap rotation module 120 of the multifunction cap replacement module 100 to further improve the safety and reliability of the multifunction cap replacement module 100 in use. In order to illustrate the interior components, the sealing wall of the cap rotation module 120 is omitted in FIG. 1.

In some embodiments, the cap rotation module central post 310 includes a ventilating channel 340 therein, and the ventilating channel 340 includes a suction port 342 formed on the base plate 360 and an exhaust port 346 connected to an external ventilating machine to exhaust the evaporated chemical gas of the chemical drum 520 and the chemical drum 530 and prevent contamination and corrosion of the cap rotation module 300, thereby further increasing the service life of the multifunction cap replacement module 100.

In some embodiments, the cap rotation module central post 310 can be rotated to position the first cap rotation device 320 and the second cap rotation device 330 to open the cap, extract and flow back the chemical liquid.

Referring to FIG. 2, the multifunction cap replacement module 200 includes a cap rotation module 210 and a horizontal moving module mounted in the cap rotation module supporter 230. The horizontal moving module can move the cap rotation module 210 around a plurality of chemical drums, e.g. the chemical drum 520 and the chemical drum 530, and align the cap rotation module 210 with one of the chemical drums to extract and flow back a desired chemical liquid. In FIG. 1, the multifunction cap replacement module 100 utilizes a plurality of cap rotation modules to respectively connect to a plurality of chemical drums to extract and flow back desired chemical liquids respectively. In FIG. 2, the multifunction cap replacement module 200 utilizes single cap rotation module to selectively connect one of a plurality of the chemical drums and extract and flow back a desired chemical liquid.

Accordingly, the multifunction cap replacement module can be safely and reliably mounted on a normal chemical drum storing device to transfer the chemical liquid of the chemical drum. The multifunction cap replacement module can also be mounted on a dedicated chemical drum storing device to transfer the chemical liquid of the chemical drum, without departing from the spirit and scope of the present invention. In addition, the multifunction cap replacement module can utilize single cap rotation module to operate a plurality of chemical drums for extracting and flowing back the chemical liquid. In addition, the multifunction cap replacement module can utilize a plurality of cap rotation modules to operate a plurality of chemical drums for extracting and flowing back the chemical liquid, without departing from the spirit and scope of the present invention.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A multifunction cap replacement module, comprising:
- a cap rotation module supporter; and
- at least one cap rotation module disposed in the cap rotation module supporter, wherein the cap rotation module comprises:
- a first cap rotation device opening a sealing cap of at least one chemical drum and extract a chemical liquid from the chemical drum; and
- a second cap rotation device opening another sealing cap of the chemical drum and flow the chemical liquid back to the chemical drum, wherein the cap rotation module further comprises:
- a base plate; and
- a cap rotation module central post connected to the base plate, wherein the first cap rotation device and the second cap rotation device are movably mounted on the base plate.

2. The multifunction cap replacement module of claim 1, wherein the cap rotation module supporter comprises:
- a horizontal moving module moving the cap rotation module around the at least one chemical drum and aligning the cap rotation module with the chemical drum.

3. The multifunction cap replacement module of claim 1, further comprising a plurality of cap rotation modules to respectively align with a plurality of chemical drums and extract chemical liquids therein.

4. The multifunction cap replacement module of claim 1, further comprising a chemical drum storing device, wherein the chemical drum storing device comprises a supporting frame to store the at least one chemical drum and the cap rotation module supporter is fixed on the supporting frame.

5. The multifunction cap replacement module of claim 1, wherein the cap rotation module central post comprises a ventilating channel exhausting an evaporated chemical gas of the at least one chemical drum out of the cap rotation module.

6. The multifunction cap replacement module of claim 5, wherein the first cap rotation device comprises a cap rotator, a liquid extractor and an optical detecting device, wherein the optical detecting device detects a positon of the sealing cap of the chemical drum to guide the cap rotator aligning with the sealing cap, and the cap rotator opens the sealing cap and the liquid extractor extracts the chemical liquid.

7. The multifunction cap replacement module of claim 6, wherein the second cap rotation device comprises a cap rotator, a liquid reflux device and an optical detecting device, wherein the optical detecting device of the second cap rotation device detects a position of another sealing cap of the chemical drum to guide the cap rotator of the second cap rotation device aligning with the another sealing cap, and the cap rotator of the second cap rotation device opens the another sealing cap, and the liquid reflux device flows the chemical liquid back to the chemical drum.

8. The multifunction cap replacement module of claim 1, further comprising:
- a fixing plate;
- a vertical moving device connected between the fixing plate and the first cap rotation device or the second cap rotation device to vertically move the first cap rotation device or the second cap rotation device; and a horizontal moving device connected between the fixing plate and the base plate to horizontally move the first cap rotation device or the second cap rotation device.

9. The multifunction cap replacement module of claim 8, further comprising:

an isolating plate; and an elastic isolating shield connected to the isolating plate and the base plate to isolate an evaporated chemical gas of the chemical drum.

* * * * *